US005890634A

United States Patent [19]

Zuckerman et al.

[11] Patent Number: 5,890,634

[45] Date of Patent: Apr. 6, 1999

[54] HANGER WITH SNAP-ON NON-SLIP PADS

[75] Inventors: Andrew M. Zuckerman, Forest Hills, N.Y.; Stephen John Pavlick, Orwigsburg, Pa.

[73] Assignee: Carlisle Plastics, Inc., North Bergen, N.J.

[21] Appl. No.: 992,987

[22] Filed: Dec. 18, 1997

[51] Int. Cl.[6] ..... A47G 25/40

[52] U.S. Cl. ..... 223/96; 223/91; 223/85

[58] Field of Search ..... 223/96, 95, 93, 223/91, 90, 85

[56] References Cited

U.S. PATENT DOCUMENTS

| | | | |
|---|---|---|---|
| 1,321,997 | 11/1919 | Duberstein | 223/85 |
| 2,920,801 | 1/1960 | Batts . | |
| 3,168,970 | 2/1965 | Willson | 223/85 |
| 3,358,891 | 12/1967 | Rowe | 223/85 |
| 3,767,092 | 10/1973 | Garrison et al. . | |
| 4,807,334 | 2/1989 | Blanchard . | |
| 5,018,650 | 5/1991 | Maufette | 223/93 |
| 5,020,705 | 6/1991 | Garrison . | |
| 5,170,916 | 12/1992 | Kolton et al. | 223/92 |
| 5,183,191 | 2/1993 | Garrison et al. . | |
| 5,361,948 | 11/1994 | Batts | 223/96 |
| 5,398,854 | 3/1995 | Blanchard | 223/96 |
| 5,516,014 | 5/1996 | Garrison | 223/96 |
| 5,535,927 | 7/1996 | Garrison | 223/92 |

*Primary Examiner*—Bibhu Mohanty
*Attorney, Agent, or Firm*—Amster, Rothstein & Ebenstein

[57] ABSTRACT

An improved clamp-type garment hanger includes: a hook, a cross-bar, and at least two clamp assemblies for securing a garment to the garment hanger. Each clamp assembly includes a pair of clamping member, at least one clamping member having an inner clamping surface defined at least in part by at least one gripping pad. A first side of the gripping pad is carried by an inner clamping surface of the one clamping member, and a second side of the gripping pad is presented for contact with a garment to be hung from the garment hanger. The second side is fabricated from gripping friction material, the coefficient of friction thereof being sufficiently high to preclude movement under the weight of the garment when a normal clamping force is applied to two clamping members to move them into clamping position. The gripping pad is secured to, but preferably manually releasable from, the one clamping member for movement as a unit into and from the clamping position.

13 Claims, 5 Drawing Sheets

FIG. 7
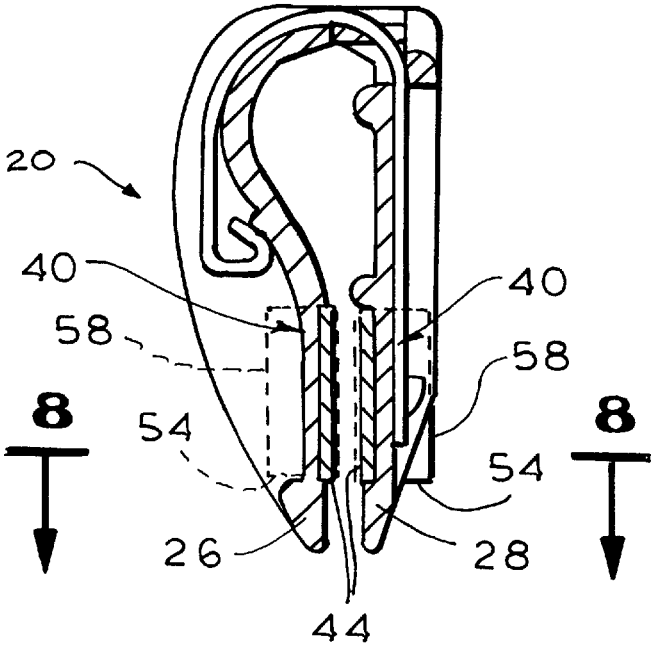
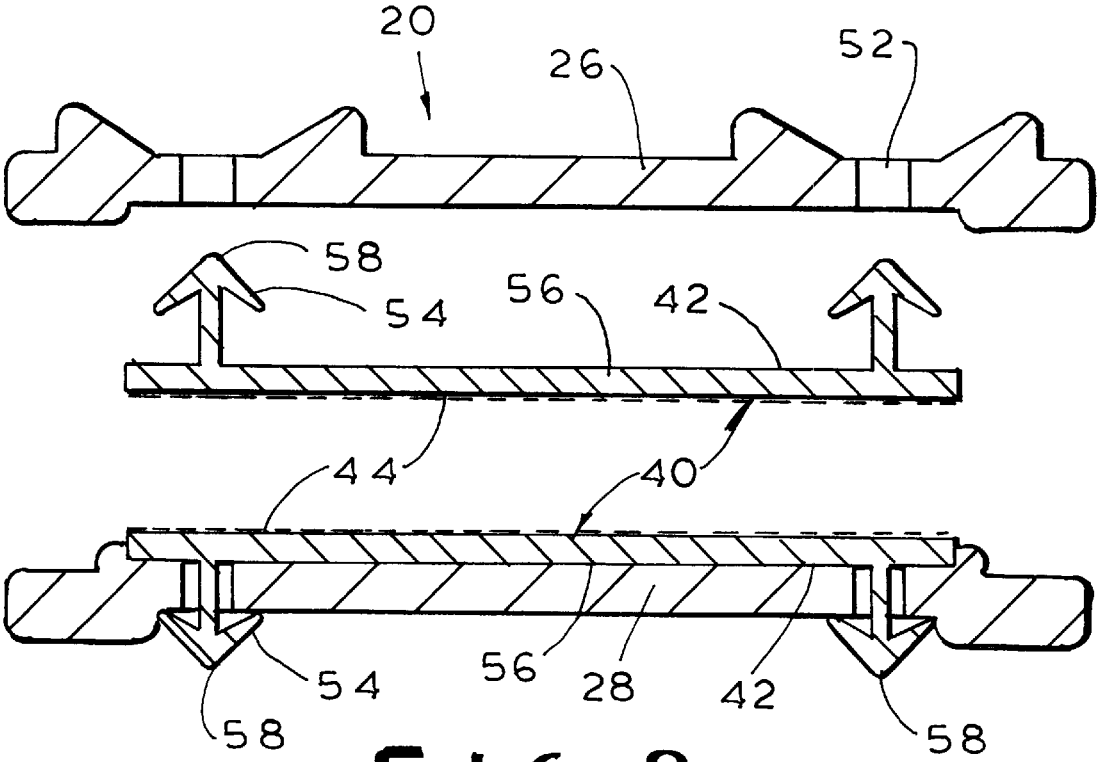
FIG. 8

HANGER WITH SNAP-ON NON-SLIP PADS

BACKGROUND OF THE INVENTION

This invention relates generally to clamp-type garment hangers with clamp assemblies that include non-slip surfaces for positively gripping garments, and more particularly to clamp-type garment hangers wherein the exposed surface of the garment gripping pad is made of resilient friction material for positively gripping the garments.

A common problem associated with today's clamp-type garment hangers is that the garments slip through the clamp assemblies (clamps) and fall to the floor with unacceptable frequency. This problem is particularly annoying to a consumer who places a relatively expensive and fragile garment, such as a pair of dress slacks or a skirt, on a clamp-style garment hanger. The slacks or skirt often slip through the clamp assemblies and fall to the floor, thereby becoming wrinkled and requiring ironing or dry cleaning.

In order to avoid this situation, manufacturers of clamp-style garment hangers have designed clamp assemblies with rough or sharp edges to positively grip the garment. However, clamp assemblies with rough garment-engaging surfaces have the potential of damaging delicate materials, such as silk or linen, through extended use. One particular problem is associated with clamp assemblies that employ outwardly protruding nipple-like projections or cleats. The nipple-like projections leave indentations in the cuffs of slacks and the waist bands of skirts. Removal of these indentations normally requires ironing or dry cleaning, or the consumer may have to wear the garment as is due to inadequate time to remove the indentations.

The above-mentioned shortcomings are not only annoying to the consumers but to the manufacturers of garments as well. First, a manufacturer cannot tolerate a clamp-type garment hanger that, with unacceptable frequency, allows the garments to slip through the clamp assemblies and fall to the floor. Manufacturers of garments often ship their expensive garments already hung on clamp-style garment hangers. The garments will wrinkle or become damaged if they fall off the hangers during transit. By the same token, retailers are very particular about product presentation and will not tolerate garment hangers that permit garments to fall onto the floor. Further, neither manufacturers nor retailers can tolerate clamp-type garment hangers that employ rough clamping surfaces or nippled clamping surfaces because such designs have the potential to damage fragile or expensive garments or at least to mar the appearance, thereby detracting from the sales appeal to the purchaser.

Hence, there is a need for a new clamp-type garment hanger that meets the aforenoted criteria. Specifically, the clamp assemblies must positively grip the garment without either marking or adhering to the garment fabric. Further, because the hanger must be capable of use as a shipping hanger by clothing manufacturers, the clamp assembly must be able to maintain its gripping ability under the rough handling resulting from the shocks and bumps to which such hangers are exposed during shipment. It is highly desirable to produce a clamp assembly with a clamping surface that is both relatively smooth to the touch and has the ability to positively grip the garments for an extended period of time. A clamping surface that is relatively smooth to the touch is pleasing to the consumer and assures the consumer that the clamping surface will not damage the garment.

A clamp-type garment hanger that meets the aforenoted criteria must also be competitive from a cost-to-produce basis.

In certain prior art clamp type gripping hangers, the gripping or non-slip material is either glue bonded to the clamping member of the garment hanger or co-molded therewith. Hangers of this design have not been found to be entirely satisfactorily. From the point of view of the manufacturer, co-molding and gluing of the gripping material are expensive and slow operations which have a deleterious effect on both the hanger production throughput and the hanger production cost. But most significantly, since the manufacturer is providing the retailer purchaser with a hanger which cannot be easily disassembled and then re-assembled to change the gripping material or the thickness or size of the gripping pad, the versatility of the garment hanger is lost. Thus the versatility of a hanger is also an important selling point. For example, if a retailer purchaser wishes to hang a delicate satin from a hanger, he may elect to use only a gripping pad which is of a lower coefficient of friction (in order to treat the satin more delicately), a pad that is larger (so that the gripping force is better distributed), or a pad that is thicker (to provide extra protection for the satin). Indeed, during the life of a given garment hanger, it may be desirable at various times for the hanger to suspend various different fabrics, each calling for particular gripping pads adapted for that fabric. Clearly, co-molded or glued gripping pads are not so replaceable by the retail customer.

Further, it is desirable that the gripping pad be securable to the hanger by an easy snap-in motion which initially occurs downstream of the hanger production line so that it does not slow down the hanger production throughput.

Finally, it is desirable for some applications that the gripping pad be securable and removable from the hanger by an easy snap-in/snap-out motion. On the other hand, in given applications where child safety concerns dictate that the gripping pad be non-removable from the hanger, it is desirable that the gripping pad be permanently securable to the hanger (at least without the use of tools) by an easy snap-in motion.

Accordingly, it is an object of the present invention to provide an improved clamp-type garment hanger wherein the gripping pad is secured to a clamping member, for movement as a unit into and from the clamping position, by manually releasable means so that the retail customer can easily change the gripping pad to accommodate the garment being suspended.

Another object to provide such a hanger wherein the gripping pad has a snap-in/snap-out relationship with a clamping member.

It is also a further object to provide such a hanger wherein, according to the intended application, the gripping pad has a permanent snap-in relationship with the clamping member.

A further object to provide such a hanger which is inexpensive to produce and versatile in its utility.

SUMMARY OF THE INVENTION

It has been found that the above and related objects of the present invention are obtained in an improved clamp-type garment hanger including hang means, a cross bar and garment suspending means. The hang means extends upwardly from the cross-bar for suspending the garment hanger from a support location. The garment suspending means includes at least one, and preferably two, clamp assemblies, each clamp assembly being located on said cross-bar for securing a garment to the garment hanger. Each clamp assembly includes a first clamping member, a second clamping member, and means for biasing the first and second clamping members toward one another and into abutting engagement with a garment located between the clamping members. Each clamp assembly includes at least one clamping member having an inner clamping surface defined at least in part by at least one gripping pad. A first side of the gripping pad is carried by the inner clamping surface of the one clamping member, and a second side of the gripping pad is presented for contact with a garment to be hung from the garment hanger. Snap-in securing means secure the gripping pad on the one clamping member for movement as a unit into and from the clamping position.

Preferably, the second side of the gripping pad is fabricated from resilient friction material, the coefficient of friction of the second side being sufficiently high to preclude movement under the weight of the garment when a normal clamping force is applied to the two clamping members to move them into a clamping position.

In a preferred embodiment, the snap-in securing means is manually releasable and secures the first side of the gripping pad and the one inner clamping surface of the one clamping member. More particularly, the one inner clamping surface defines a spaced pair of recesses or slots, and the gripping pad defines a spaced pair of lugs configured and dimensioned to be manually releasably retained in the recesses or slots. The gripping pad includes on the first side a resilient element biasing the lugs into a retaining orientation relative to the recesses or slots, but being responsive to manual pressure applied thereto to move the lugs out of the retaining orientation. The lugs and the recesses or slots are in a snap-in/snap-out relationship. The resilient element is preferably formed of a generally rigid material such as polyvinyl chloride, and the gripping friction material is preferably a tacky, flexible polyvinyl chloride or polypropylene. Preferably, the inner clamping surface is defined by a single gripping pad.

In a different preferred embodiment affording child protection, the snap-in securing means is not manually releasable and is either permanently mounted or, at the very least, requires the use of tools in order to remove the same from the hanger. The spaced pair of lugs of the gripping pad may still be configured and dimensioned to be easily, releasably retained in the recesses or slots, but the clamping assembly may preclude access to the lugs so that they cannot be easily removed from the hanger. Alternatively, the resilient element biasing the lugs into the retaining orientation relative to the recesses or slots may not be responsive to manual pressure applied thereto to move the lugs out of the retaining orientation, and may require additional force exerted by a tool. Thus, the lugs and the recesses or slots would be in a snap-in relationship but not a snap-out relationship.

In yet another preferred embodiment, in each clamp assembly each clamping member has an inner clamping surface defined at least in part by at least one gripping pad.

BRIEF DESCRIPTION OF THE DRAWING

The above and related objects, features and advantages of the present invention will be more fully understood by reference to the following detailed description of the presently preferred, albeit illustrative, embodiment of the present invention when taken in conjunction with the accompanying drawing wherein:

FIG. 7 is a sectional view similar to FIG. 5, but of a second embodiment of the clamping assembly in its clamping position;

FIG. 8 is a sectional view taken along the line 8—8 of FIG. 7, with a portion thereof exploded to show the rear clamping member and the resilient pad prior to joinder.

DETAILED DESCRIPTION OF THE PREFERRED EMBODIMENTS

Figure 1:
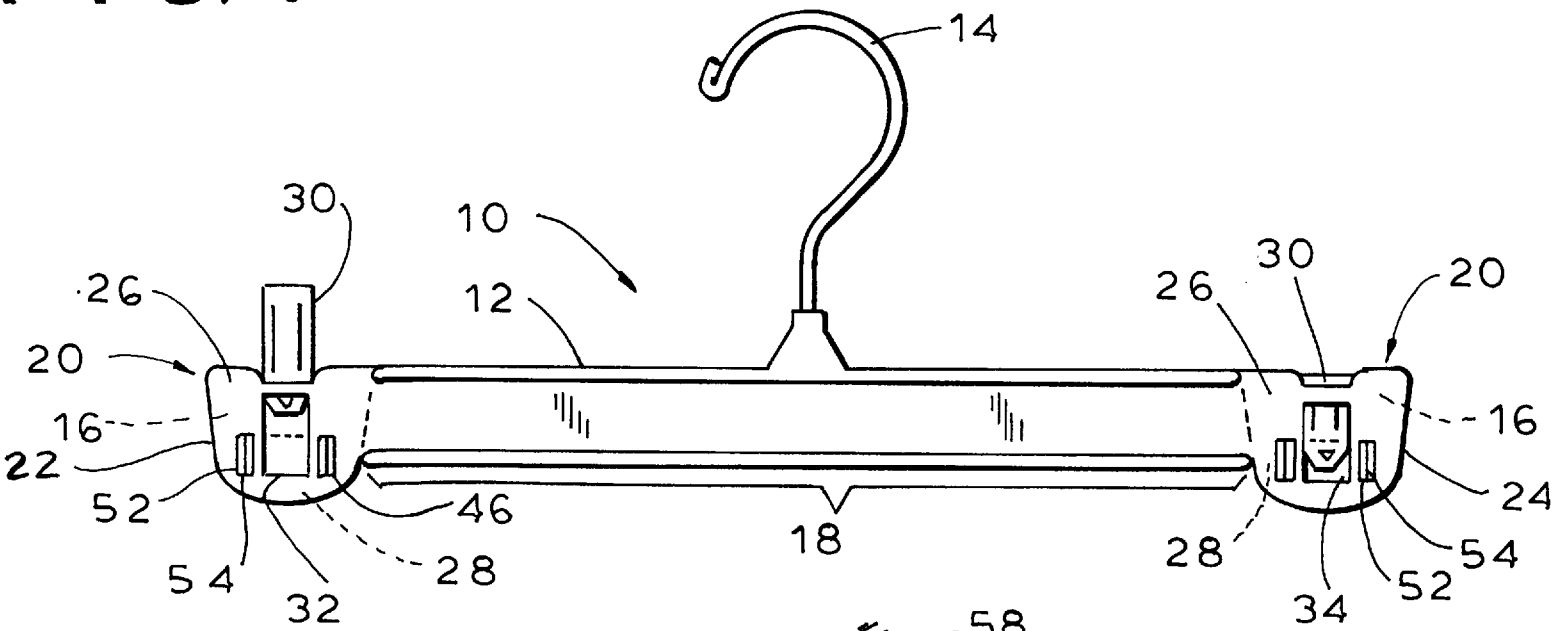
FIG. 1 is a front elevational view of a first embodiment of a hanger according to the present invention, with the clip of one clamp assembly being shown in the open or upper position and the clip of the other assembly being shown in the closed or lowered (clamping) position.
Figure 2:
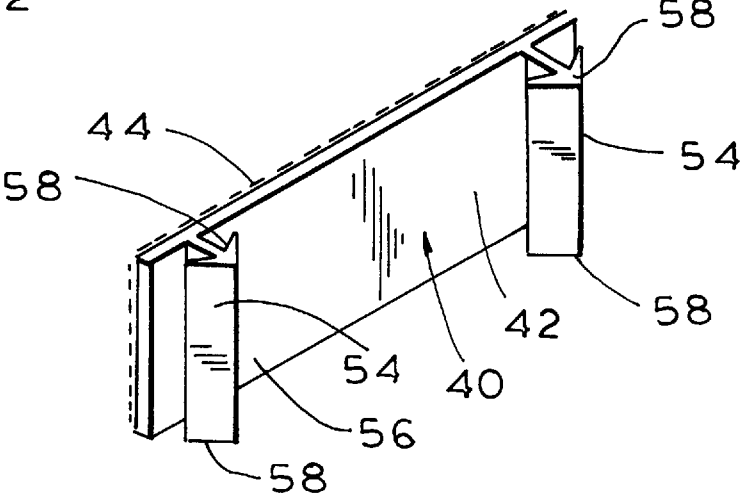
FIG. 2 is a isometric view of a gripping pad according to the present invention.
Figure 4:
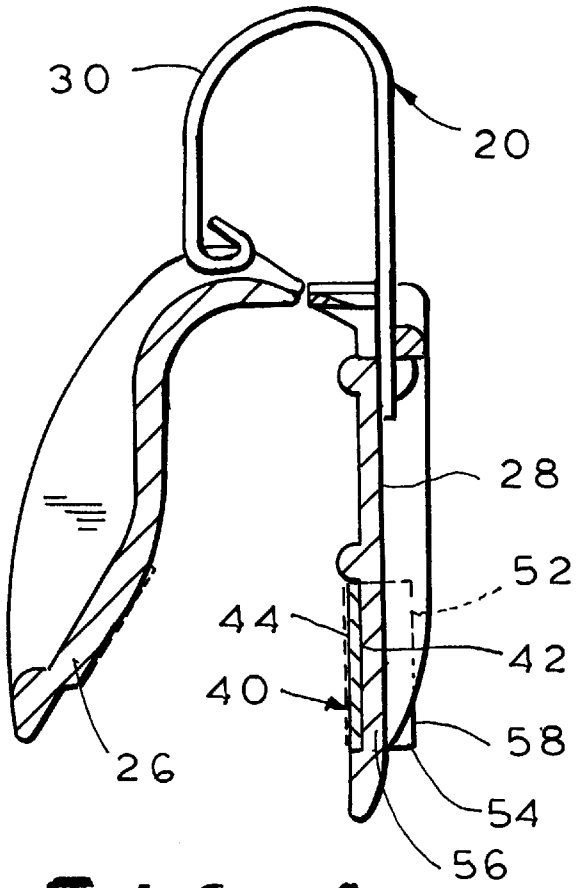
FIG. 4 is a sectional view thereof taken along the lines 4—4 of FIG. 3.

Referring now to the drawing and in particular FIG. 1 thereof, therein illustrated is a first preferred embodiment of a garment hanger according to the present invention, generally designated by the reference numeral 10. In its conventional aspects, the hanger 10 comprises a cross-bar 12, a hang means 14 (such as a hook), and garment suspending means, generally designated 20. The cross-bar 12 has two end portions 16 and a central portion 18 intermediate the end portions 16. The hang means 14 extends upwardly from the central portion 18 of the cross-bar 12 for suspending the garment hanger 10 from a support (not shown). The hanger is preferably formed from styrene-butadine-styrene plastic (SBS) or polypropylene (PP).

In its conventional aspects, the garment suspending means 20 includes at least one clamp assembly, and preferably two clamp assemblies 22 and 24. The two clamp assemblies 22, 24 are located at opposite ends 16 of the cross-bar 12 so that each clamp assembly 22, 24 is located at a respective one of the end portions 16 of the cross-bar 12 for securing the garment to the garment hanger 10. Each clamp assembly 22, 24 includes a first or front clamping member 26, a rear or second clamping member 28, and means for biasing the two clamping members 26, 28 toward one another and into an abutting engagement with a garment located between the clamping members 26, 28. The front and rear clamping members 26, 28 are spring-biased toward the garment clamping position by a U-shaped biasing clamp 30. An elongated, vertically oriented aperture 32 is defined by the front clamping member 26, and a similar aperture 34 is defined by the rear clamping member 28. The apertures 32, 34 accommodate the legs of the U-shaped clamp 30 which pivotally reciprocate between an upper or disengaged position and a lower or engaged (and clamped) position.

Referring now also to FIGS. 1–6 in particular, each clamp assembly 22, 24 includes at least one clamping member 26 or 28 (member 26 being best illustrated in FIG. 3) having an inner clamping surface defined at least in part by at least one gripping pad, generally designated 40. Depending upon the anticipated applications of the hanger, each of the clamping members 26 and 28 of a clamp assembly 22, 24 may have its inner clamping surface defined at least in part by a gripping pad 40, as illustrated in FIGS. 7–8. Again, depending upon the applications anticipated for the hanger, at least one clamping member 26, 28 may have an inner clamping surface defined by more than one gripping pad 40, thereby increasing the effective size of the inner clamping surface.

A first side 42 of the gripping pad is carried by the inner clamping surface of the clamping member 26, 28, and a second side 44 of the gripping pad 40 is presented for contact with a garment G to be hung from the garment hanger 10. Where the inner clamping surface of each of the clamping members 26, 28 bears a gripping pad 40, as illustrated in FIGS. 7–8, the two gripping pads 40 are opposed and act in cooperation to positively grip the garment G when the clamp assembly 26, 28 is in the garment clamping position. Where a gripping pad 40 is provided for only one of the two clamping members 26, 28, as illustrated in FIGS. 1–6, the second side 44 of the gripping pad 40 is biased towards the opposed surface of the other clamping member 28, 26, with a garment G to be hung from the garment hanger being maintained between the second side 44 of the gripping pad 40 and the inner clamping surface of the other clamping member 28, 26.

As illustrated, the cross-bar 12, the suspending device 14 and both rear clamping members 28 are molded together and integrally connected. The front clamping members 26 are molded separately and are physically attached to the rear clamping members 28 by the U-shaped clamps 30 and a pivot mechanism.

The second side 44 of each gripping pad 40 is fabricated from resilient friction material. The coefficient of friction of the second side 44 is selected so that it is sufficiently high to preclude movement of a garment G, under the weight of the garment, when a normal clamping force is applied to the two clamping members to move them into a clamping position.

Preferred resilient friction materials for the gripping pad second side 44 are tacky materials such as flexible polyvinyl chloride and polypropylene.

The present invention is equally applicable to other clamp-type garment hangers—for example, one wherein the clamp assembly has one clamping member defining a downwardly-extending finger and the other clamping member defining two downwardly extending fingers. The one downwardly extending finger is aligned so as to fill in between the two downwardly extending fingers in the garment clamping position. In this embodiment each downwardly extending finger has an inner clamping surface, and at least one of the inner clamping surfaces (if not all three) may include at least one gripping pad. Similarly, the hanger may utilize a cross-bar which is adjustable in width, with the end portions being spring biased outwardly relative to the central portion. Similarly, the hanger may utilize a cross-bar with a single centrally located clamping assembly.

Figure 3:
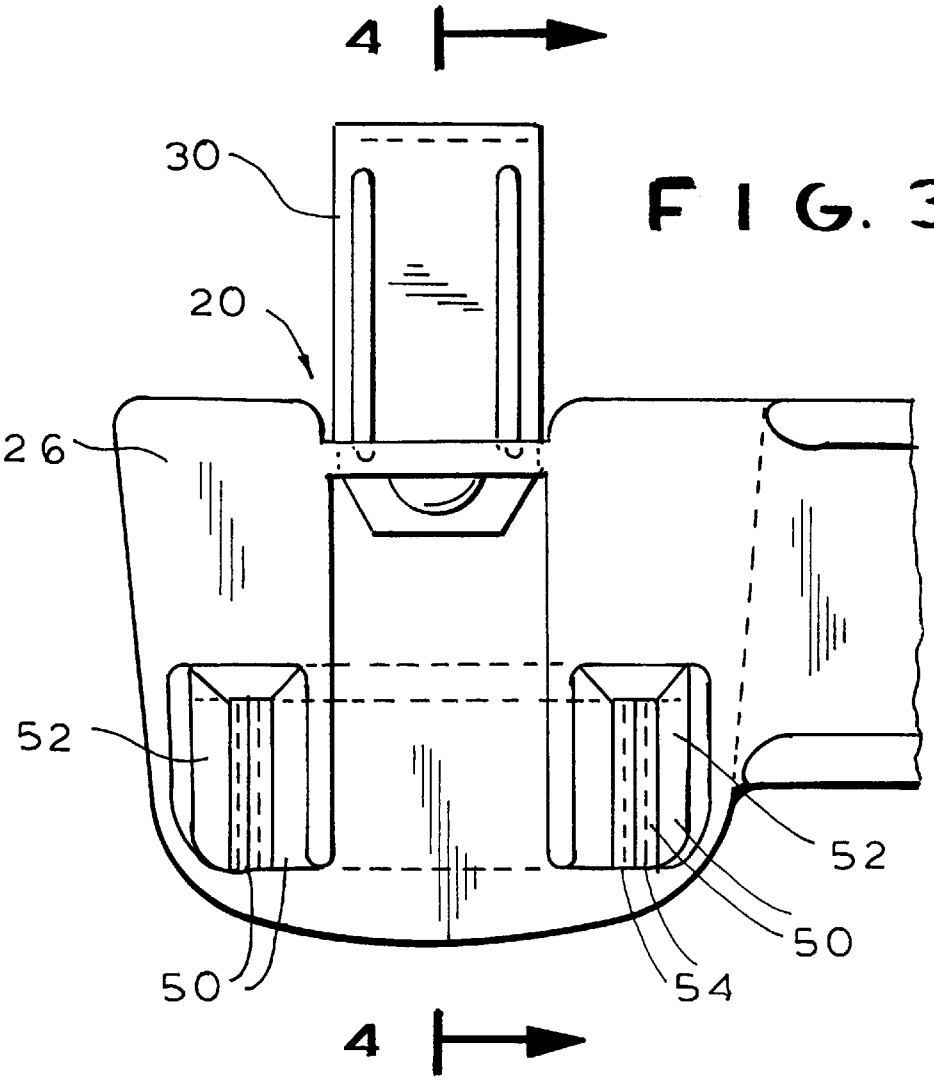
FIG. 3 is a fragmentary view of the open clamp assembly of FIG. 1, to an enlarged scale.
Figure 6:
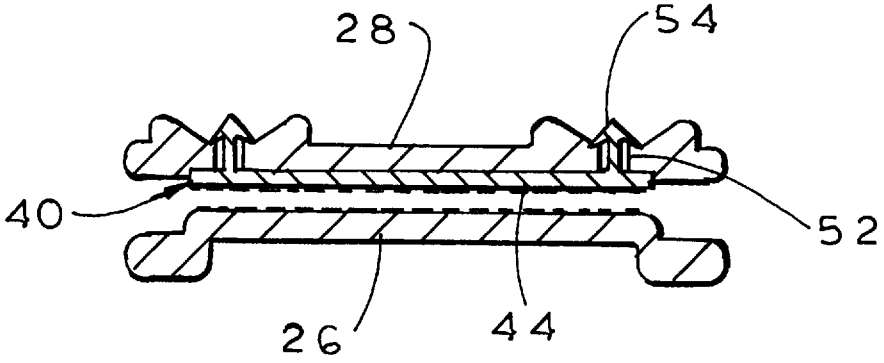
FIG. 6 is a sectional view taken along the line 6—6 of FIG. 5.
Figure 5:
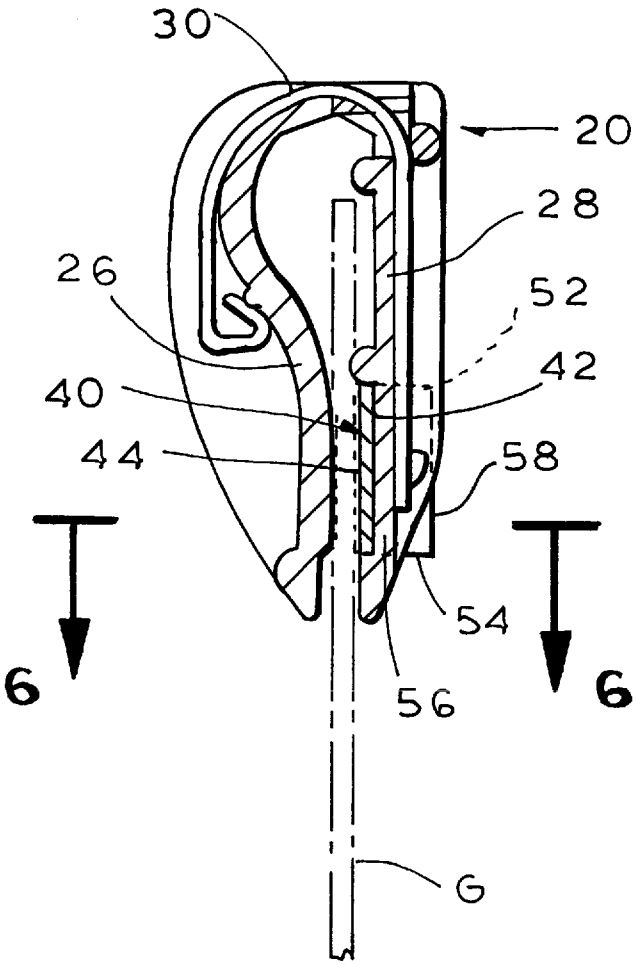
FIG. 5 is a sectional view similar to FIG. 4, but taken of the clamping assembly in its closed or clamping position and with a garment G (illustrated in phantom line) suspended thereby.

The gripping pad 40 is secured to its respective clamping members 26, 28 for movement as a unit into and from the clamping position by manually releasable snap-in means 50 (see FIG. 3). The manually releasable snap-in securing means 50 secures the first side 42 of the gripping pad 40 and the inner clamping surface of a clamping member 26, 28, leaving the second side 44 of the gripping pad 40 exposed for contact with the garment to be hung from the garment hanger 10.

In the illustrated embodiment, the manually releasable securing means 50 includes (a) the inner clamping surface of clamping member 26, 28 defining a spaced pair of recesses or slots 52, and (b) the gripping pad 40 defining a spaced pair of lugs 54 configured and dimensioned to be easily releasably retained in the recesses or slots 52. The gripping pad 40 of the present invention includes on its first side 42 a resilient element or backing 56 biasing the lugs 54 (as illustrated, towards one another) into a retaining orientation relative to the recesses or slots 52. But the resilient element 56 remains responsive to manual pressure applied thereto to move the lugs 54 (as illustrated, away from each other) out of the retaining orientation for easy removal. The resilient element 56 may be glued, bonded, or otherwise secured to the clamping member 26, 28 for movement as a unit. Indeed, the resilient element 56 and the resilient friction material 44 may be unitarily co-molded.

The resilient element 56 is preferably formed of a generally rigid material such as polyvinyl chloride, although polyethylene, nylon or polypropylene may be used instead.

Preferably the distal end portion 58 of each lug 54 is slightly enlarged relative to the thickness of the remainder of the lug so that, when the lug 54 is forcibly inserted into a recess or slot 52, the natural bias of the lug 54 maintains the lug in place within the recess or slot 52. Preferably, the bottom of the lug 54, and especially the enlarged distal portion 58 thereof, are bevelled or slightly rounded so as to facilitate initial camming of the lug 54 by the portion of the clamping member 26, 28 defining the recess or slot 52 so that the lug 54 easily enters into the recess or slot 52.

Once the spaced pair of lugs 54 enter the spaced pair of recesses or slots 52, they are maintained there against accidental displacement by the biasing of the resilient element 56. However, the gripping pad 40 may be manually released from a clamping member 26, 28 by the use of sufficient force (exerted by a hand alone without the use of a tool such as a screw driver) to cause the lugs 54 to cam inwardly, relative to the portion of the clamping member 26, 28 defining the recesses or slots 52, until the enlarged portions 58 exit the same.

The snap-in/snap-out connection of the gripping pad 40 and its respective clamping member 26, 28 facilitates placement of the gripping pad 40 on the clamping member 26, 28 downstream of the production operation where the cross-bar 12, suspending device 14, and clamp assemblies 22, 24 are formed (e.g., injection molded). Further, the snap-in/snap-out relationship allows the gripping pads 40 to remain in place, despite minor dislodging forces being applied thereto, while enabling the gripping pad 40 to be separated from the clamping member through the application of appropriate manual force. Thus, the retailer customer of the hanger can easily and rapidly change the gripping pad 40 or pads of a hanger 10, thereby to modify the material, thickness and size (length and height) of the pads so as to utilize the best pads for a given garment to be suspended.

It will be appreciated that, for particular applications where it is uncertain whether or not the clamping assemblies will be used with gripping pads 40 or not, the inner clamping surface of each clamping member 26, 28 may be designed to secure in a conventional manner a garment to be hung from the hanger. In other words, the inner clamping surface of the clamping member may have a rough or nippled clamping surface. Thus, the purchaser can use the hanger without the gripping pads or, simply by manual insertion of the gripping pads onto the clamping members, with the gripping pads. In the latter instance, the gripping pads preferably totally block the rough or nippled region of the clamping member so that only the gripping pad contacts the garment to be hung from the hanger.

Figure 9:
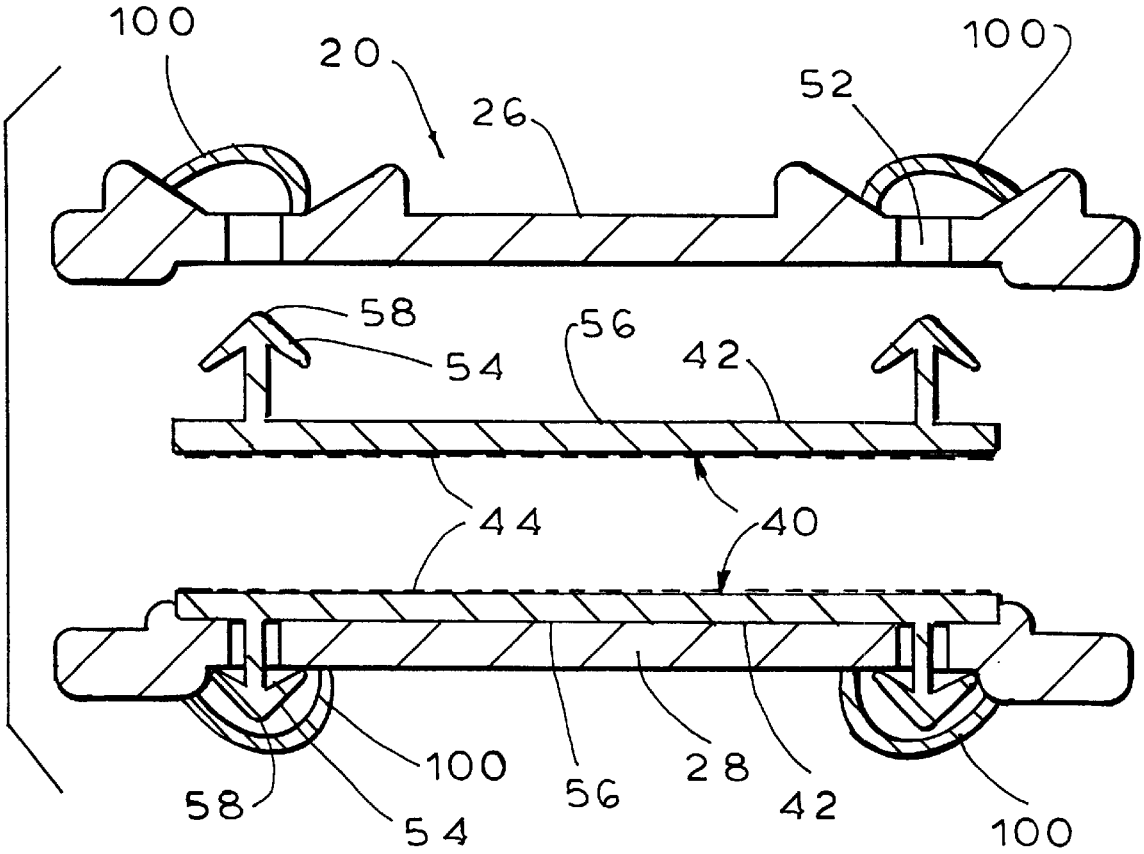
FIG. 9 is a sectional view similar to FIG. 6 of a second embodiment of a hanger according to the present invention.

Referring now to FIG. 9 in particular, therein illustrated is a second preferred embodiment of the garment hanger according to the present invention, generally designated by the reference numeral 10'. It is substantially identical to the first preferred embodiment 10 except that each clamping member 26, 28 additionally defines shields 100 on its exposed surface. The shields 100 preclude manual access to the lugs 54 so that, once the lugs 54 are in place in their recesses or slots 52, they are not manually removable therefrom. They may be removable through use of a tool such as an awl or screw driver, but such tools are not typically accessible to the child of an age where the removed gripping pad 40 might be put in its mouth by the child. As illustrated, the shield 100 may simply be an extension of the clamping member 26, 28 prime, extending around the back of each recess or slot 52 without interfering with the movement of the lug 54 thereinto.

To summarize, the present invention provides an improved clamp-type garment hanger wherein the gripping pad is secured to a clamping member, for movement as a unit into and from the clamping position, by manually releasable means, so that the retail customer can easily change the gripping pad to accommodate the garment being suspended. The gripping pad has a snap-in/snap-out relationship with the clamping member so that the hanger is inexpensive to produce and versatile in its utility. Alternatively, the gripping pad may have only a snap-in relationship with the clamping member so that the hanger is safe for use in the presence of children as the gripping pad cannot be manually removed.

Now that the preferred embodiments of the present invention were shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. An improved clamp-type garment hanger, the hanger comprising:

(A) hang means and a cross-bar, said hang means extending upwardly from said cross-bar for suspending the garment hanger from a support location; and (B) garment suspending means including at least one clamp assembly located on said cross-bar for securing a garment to the garment hanger;

(i) each clamp assembly including a first clamping member, a second clamping member, and means for biasing said first and second clamping members toward one another and into abutting engagement with a garment located between said clamping members, each clamp assembly including at least one clamping member having an inner clamping surface defined at least in part by at least one gripping pad;

a first side of said gripping pad being carried by said inner clamping surface of said one clamping member, and a second side of said gripping pad being presented for contact with a garment to be hung from the garment hanger;

snap-in means securing said gripping pad on said one clamping member for movement as a unit into and from the clamping position.

2. The hanger of claim 1 wherein said securing means secures said first side of said gripping pad and said one inner clamping surface of said one clamping member.

3. The hanger of claim 1 wherein said one inner clamping surface defines a spaced pair of recesses or slots, and said gripping pad defines a spaced pair of lugs configured and dimensioned to be retained in said recesses or slots.

4. The hanger of claim 3 wherein said lugs and said recesses or slots are in a snap-in/snap-out relationship.

5. The hanger of claim 3 wherein said gripping pad defines a spaced pair of lugs configured and dimension to be manually releasably retained in said recesses or slots, and said gripping pad includes on said first side a resilient element biasing said lugs into a retaining orientation relative to said recesses or slots, but being responsive to manual pressure applied thereto to move said lugs out of the retaining orientation.

6. The hanger of claim 5 wherein said resilient element is formed of a generally rigid polyvinyl chloride.

7. The hanger of claim 1 wherein, in each said clamp assembly, each said clamping member has an inner clamping surface defined at least in part by at least one gripping pad.

8. The hanger of claim 1 wherein said inner clamping surface is defined by a single gripping pad.

9. The hanger of claim 1 wherein said gripping friction material is a tacky, flexible polyvinyl chloride.

10. The hanger of claim 1 wherein said second side of said gripping pad is fabricated from resilient friction material, the coefficient of friction of said second side being sufficiently high to preclude movement under the weight of the garment when a normal clamping force is applied to said two clamping members to move them into a clamping position.

11. The hanger of claim 1 wherein said snap-in means is not manually releasable.

12. The hanger of claim 1 wherein said one clamping member includes on its exposed surface a shield precluding access to said spaced pair of lugs.

13. An improved clamp-type garment hanger, the hanger comprising:

(A) hang means and a cross-bar having two end portions and a central portion intermediate said end portions, said hang means extending upwardly from said central portion of said cross-bar for suspending the garment hanger from a support location; and (B) garment suspending means including two clamp assemblies, each said clamp assembly being located at a respective one of said end portions of said cross-bar for securing a garment to the garment hanger;

(i) each clamp assembly including a first clamping member, a second clamping member, and means for biasing said first and second clamping members toward one another and into abutting engagement with a garment located between said clamping members, each clamp assembly including at least one clamping member having an inner clamping surface defined at least in part by at least one gripping pad;

a first side of said gripping pad being carried by said inner clamping surface of said one clamping member, and a second side of said gripping pad being presented for contact with a garment to be hung from the garment hanger, said second side being fabricated from resilient friction material, the coefficient of friction of said second side being sufficiently high to preclude movement under the weight of the garment when a normal clamping force is applied to said two clamping members to move them into a clamping position;

manually releasable means securing said first side of gripping pad on said one inner clamping surface of said one clamping member for movement as a unit into and from the clamping position;

said one inner clamping surface defining a spaced pair of recesses or slots, and said gripping pad defining a spaced pair of lugs configured and dimensioned to be manually releasably retained in said recesses or slots, said gripping pad including on said first side a resilient element biasing said lugs into a retaining orientation relative to said recesses or slots, but being responsive to manual pressure applied thereto to move said lugs out of the retaining orientation, whereby said lugs and said recesses or slots are in a snap-in/snap-out relationship.

* * * * *